US005147155A

United States Patent [19]

Hansen

[11] Patent Number: 5,147,155

[45] Date of Patent: Sep. 15, 1992

[54] DEVICE FOR ACHIEVING UNIFORM DISTRIBUTION OF AIRBORNE FIBRES, E.G. CELLULOSE-FIBRES

[75] Inventor: Kjell Hansen, Jersoy, Norway

[73] Assignee: Molnlycke AB, Gothenburg, Sweden

[21] Appl. No.: 679,001

[22] PCT Filed: Nov. 14, 1989

[86] PCT No.: PCT/SE89/00658

§ 371 Date: May 2, 1991

§ 102(e) Date: May 2, 1991

[87] PCT Pub. No.: WO90/05689

PCT Pub. Date: May 31, 1990

[30] Foreign Application Priority Data

Nov. 15, 1988 [SE] Sweden ..... 8804118

[51] Int. Cl.[5] ..... B65G 51/18; B02C 7/02

[52] U.S. Cl. ..... 406/191; 406/52; 406/154; 241/62; 241/243

[58] Field of Search ..... 406/154, 162, 164, 52, 406/69, 191; 241/243, 62; 19/205, 97, 97.5, 93, 94

[56] References Cited

U.S. PATENT DOCUMENTS

| | | | |
|---|---|---|---|
| 2,807,054 | 9/1957 | Burger . | |
| 2,828,923 | 4/1958 | Kramer . | |
| 3,581,706 | 6/1971 | Rasmussen . | |
| 3,976,252 | 8/1976 | PerDue | 241/243 X |
| 4,176,427 | 12/1979 | Neuenschwander . | |
| 4,214,713 | 7/1980 | Wright . | |

FOREIGN PATENT DOCUMENTS

| | | | |
|---|---|---|---|
| 1929465 | 12/1970 | Fed. Rep. of Germany . | |
| 2338108 | 3/1974 | Fed. Rep. of Germany | 241/243 |
| 1017269 | 2/1952 | France | 241/243 |
| 271610 | 9/1989 | German Democratic Rep. | 241/243 |
| 0339994 | 11/1971 | Sweden . | |
| 0356465 | 5/1973 | Sweden . | |
| 249342 | 1/1970 | U.S.S.R. | 241/243 |

*Primary Examiner*—Margaret A. Focarino
*Assistant Examiner*—James M. Kannofsky
*Attorney, Agent, or Firm*—Young & Thompson

[57] ABSTRACT

A device for achieving uniform distribution of airborne fibres, for instance cellulose-fibres, in the outlet of a conduit intended for the air-transport of fibres, the device being placed in the outlet (10) of the conduit. In accordance with the invention, the device includes a plurality of mutually similar, concentrically arranged circular rotors (1) and a plurality of semi-circular stators (6) which are disposed between the rotors on the outlet side of the device.

7 Claims, 2 Drawing Sheets

DEVICE FOR ACHIEVING UNIFORM DISTRIBUTION OF AIRBORNE FIBRES, E.G. CELLULOSE-FIBRES

The present invention relates to a device for achieving uniform distribution of airborne fibres, for instance cellulose-fibres, in the outlet of a conduit intended for the transportation of airborne fibres, said device being placed in said outlet.

In the manufacture of absorption bodies, it is normal practice to suck airborne cellulose-fibres into a vacuum mould provided with an air-permeable bottom, with the aid of subpressure, in a manner such as to fill the mould and to ensure that the fibres are held therein. The absorption body formed in the mould is, at present time, subjected to further treatment, such as to compaction for instance, in order to improve its properties. It is also known to produce absorption bodies which consist of two sub-bodies of mutually different densities, so as to improve the total absorption and liquid-dispersing properties of the absorbent body.

With this in mind, it will be understood that progressively higher demands are placed on the homogenity of the absorption bodies produced, and that local variations in density, for instance due to agglomeration of the airborne fibres introduced into a mould, cannot be tolerated to the same extent as was previously the case.

Consequently, in order to produce homogenous absorption bodies it is essential that the airborne fibres supplied to a vacuum mould are distributed uniformly in the air flow carrying said fibres. Unfortunately, this is not achieved in the case of present day air-transportation conduits, in which fibre-agglomerates, reaching the size of table-tennis balls in some instances, are formed to varying degrees, depending on the lengths of the conduits concerned and the manner in which the conduits are laid and positioned, the moisture content, etc.

The object of the present invention is to solve the above-mentioned problem by mounting in the outlet of an air-transportation conduit a device which is operative to break-up any agglomerates which may form and to ensure that the airborne fibres will be uniformly distributed when exiting from the conduit.

To this end, there is provided, in accordance with the invention, a device which comprises a plurality of mutually similar and concentrically arranged circular rotors and a plurality of semi-circular stators, which are disposed between the rotors on the outlet side of the device. Because the through-flow area on the outlet side of the device is reduced drastically by the presence of the rotors and stators, the velocity of the air flow will be increased markedly during its passage through the device-outlet. This increase in velocity, together with the rotary motion of the rotors, will produce turbulence in the air flow within the device, this turbulence either being effective to disintegrate fibre-agglomerates directly or in causing the fibres of higher velocity to strike against the rotor or stator walls.

An exemplifying embodiment of the invention will now be described with reference to the accompanying drawings, of which FIG. 1 shows a rotor forming part of the inventive device, from above;

Figure 1:
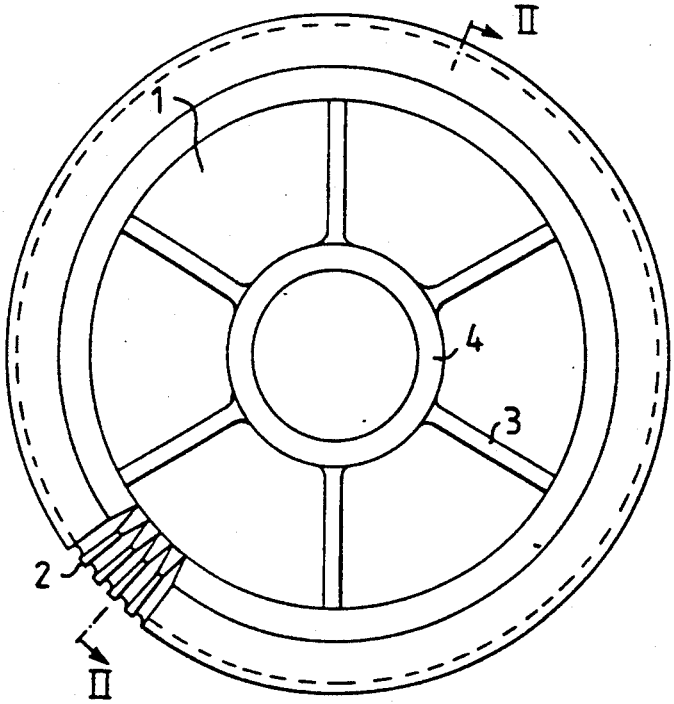
Figure 2:
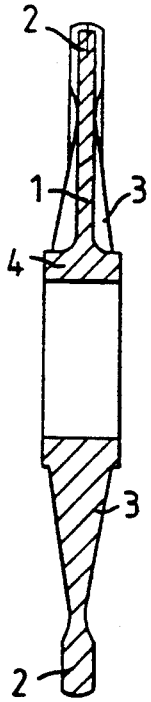
FIG. 2 is a cross-sectional view taken on the line II—II in FIG. 1.

FIGS. 1 and 2 illustrate a circular rotor 1 which forms part of the inventive device. The mutually opposing surfaces of the rotor periphery have provided thereon turbulence-generating elements, which in the case of the illustrated and described embodiment have the form of ribs 2 which extend from the rim of the rotor in towards the centre thereof. The radial extension of the ribs is suitably equal to one-quarter of the radius. The mutually opposing surfaces of the rotor are also provided with stiffening ribs 3, which extend radially from the rotor hub 4 to a location level with the inward extremity of the turbulence-generating ribs 2.

Figure 3:
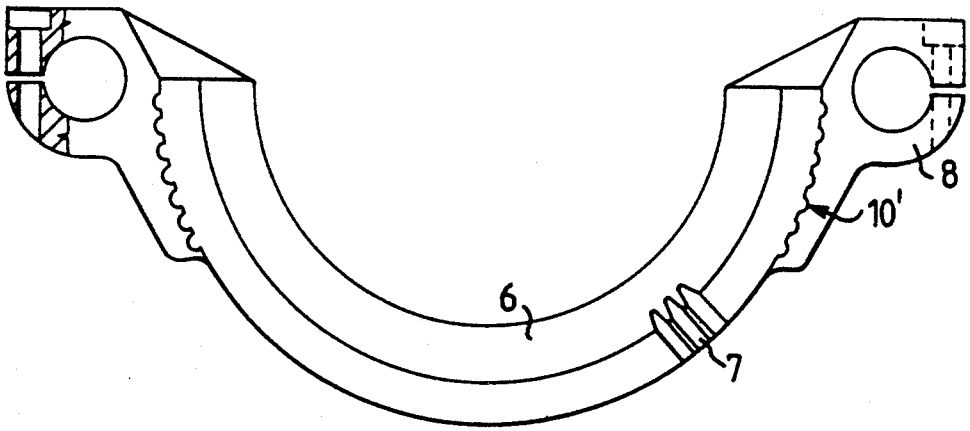
FIG. 3 shows a stator forming part of the inventive device from above.

FIG. 3 illustrates a stator 6 which forms part of the inventive device and which is semi-circular in shape. The stator 6 also has radially extending ribs provided on the periphery thereof, these ribs being referenced 7 and having the same form as the turbulence-generating ribs 2 on the rotor 1. Arranged at either end of the stator is a respective attachment means 8 which, in the illustrated case, enable the stator to be clamped firmly to vertical rods.

Figure 4:
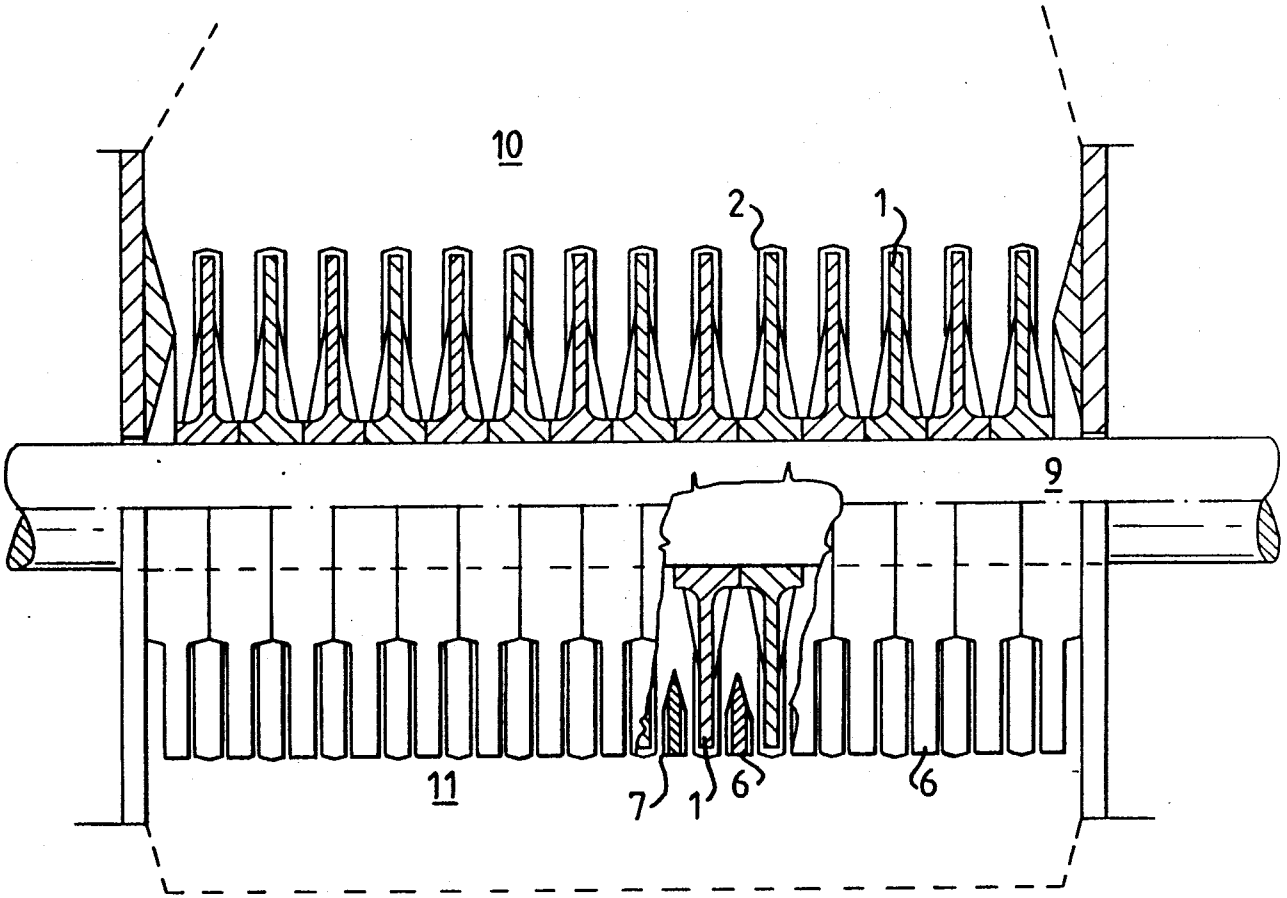
FIG. 4 is a sectional view of a device constructed in accordance with the invention.

FIG. 4 is a sectional view of an inventive device comprising rotors 1 and stators 6 located between the ribs. The spacing between the ribs 2 and 7 of the rotors and stators respectively is preferably 2 mm. The rotors are mounted on a shaft 9 by means of some suitable connecting means, for example by means of a key or spline connection. The shaft 9 is driven for rotation by means of a drive (not shown), for instance a belt transmission connected to the output shaft of an electric motor. The rotors may be rotated at a speed of from 3000 to 5500 rpm.

As beforementioned, the inlet side of the device is connected to the outlet 10 of a conduit intended for transporting airborne fibres, and the outlet side of the device is connected to the inlet of a fibre-delivery chamber from which airborne fibres are sucked into vacuum moulds.

Figure 5:
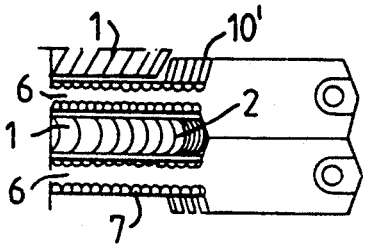
FIG. 5 is a part view seen in a direction from the outlet side of the inventive device towards the inlet side thereof.

FIG. 5 is a part view illustrating that the sequentially stacked stators 6 form side-wall sections of the inventive device. These side-wall sections are provided with grooves or channels 10', as illustrated in FIGS. 3 and 5.

The device operates in the following manner.

As the result of pressure difference, the air will flow from the transport conduit outlet 10 through the device and into the inlet 11 of the fibre-delivery chamber. Because the through-flow area of the device on the outlet side thereof is much smaller than on the inlet side of said device, due to the presence of the rotors 1 and stators 6, the velocity of the air will increase markedly in the region of the stationary stators 6. As the rotors rotate at high speed, powerful turbulence is created in this region of the device. This turbulence is effective to disintegrate any fibre agglomerates present in the air/fibre mixture arriving from the transport conduit, such disintegration being effected directly, or indirectly by high-velocity impact of the fibre agglomerates against the walls of the rotors or stators. The rotational movement of the rotors will also impart to the fibres a velocity component acting in the direction of rotor rotation, and consequently the fibres will be uniformly distributed peripherally upon their exit from the device. Uniform distribution of the fibres in an axial direction is achieved by the local air-vortices created on the outlet side of the device immediately externally of the periphery of the rapidly rotating rotors.

The width of the gap between stators and rotors will naturally be selected primarily in dependence on the dimensions of the fibres. It has been found experimentally that a gap of 2 mm provides good results in the case of cellulose fibres. Although narrower gaps are conceivable, the devices then required for handling the air/fibre mixture flowing through the transportation conduit at a speed of 20–30 m/sec become much too bulky and unmanageable, due to the fact that the through-flow capacity of the inventive device is then relatively small. Gap widths of up to 3 mm will also provide acceptable values of fibre distribution in the air exiting from the device.

As will be understood, the inventive device can be modified in several respects within the scope of the invention. For instance, the shape of the rotors and the number of rotors used can be varied, and the turbulence-generating elements may have a form different to that illustrated. The invention is therefore restricted solely by the scope of the following claims.

I claim:

1. A device for achieving uniform distribution of airborne fibres, for instance cellulose-fibres, in the outlet of an air-transport fibre conduit, said device being placed in said outlet (10) and having an outlet side and an inlet side, characterized in that the device includes a plurality of mutually similar and concentrically arranged circular rotors (1), and a plurality of semi-circular stators (6) which are disposed between the rotors on the outlet side of the device.

2. A device according to claim 1, characterized in that the rotors have provided on tips thereof ribs which extend between mutually opposing surfaces of the rotors.

3. A device according to claim 1, characterized in that turbulence-generating elements (2, 7) are provided on mutually opposing side-surfaces of the rotors (1) and the stators (6).

4. A device according to claim 3, characterized in that the turbulence-generating elements comprise ribs (2, 7) which extend radially from the periphery of the rotors and the stators in towards the centres thereof.

5. A device according to claim 4, characterized in that the radial extension of the ribs is approximately equal to one quarter of the radius of said rotors and said stators.

6. A device according to claim 5, characterized in that a gap defined between the turbulence-generating elements of the stators and the rotors has a width of 1 to 3 mm.

7. A device according to claim 6, characterized in that the gap defined between the turbulence-generating elements of said rotors and said stators has a width of 2 mm.

* * * * *